US005127611A

United States Patent [19]

Payne et al.

[11] Patent Number: 5,127,611

[45] Date of Patent: Jul. 7, 1992

[54] MINIATURE KITE

[76] Inventors: Douglas L. Payne; Lois A. Payne, both of 8301 16½ Mile Rd., #96, Sterling Heights, Mich. 48312

[21] Appl. No.: 725,970

[22] Filed: Jul. 5, 1991

Related U.S. Application Data

[63] Continuation-in-part of Ser. No. 434,920, Nov. 13, 1989, abandoned.

[51] Int. Cl.[5] ..... B64C 31/06

[52] U.S. Cl. ..... 244/153 R

[58] Field of Search ..... 244/153, 155

[56] References Cited

U.S. PATENT DOCUMENTS

| | | | |
|---|---|---|---|
| D. 24,989 | 12/1895 | Blauss . | |
| D. 166,637 | 4/1952 | Robey | D34/15 |
| D. 223,381 | 4/1972 | Carpenter et al. | D21/1 |
| D. 246,807 | 12/1972 | Moore | D34/15 |
| 1,005,810 | 10/1911 | Conyne . | |
| 1,021,278 | 3/1912 | Thayer . | |
| 1,453,287 | 5/1923 | Sellers . | |
| 1,480,889 | 1/1924 | Massa . | |
| 1,486,368 | 3/1924 | Eckmann | 244/153 |
| 1,494,453 | 5/1924 | Wanner . | |
| 1,564,616 | 12/1925 | Pantsos . | |
| 1,781,662 | 11/1930 | Cabrera . | |
| 1,782,557 | 11/1930 | Wilder . | |
| 2,479,473 | 8/1949 | Cox | 244/153 |
| 2,484,096 | 10/1949 | Kay | 244/153 |
| 2,508,747 | 5/1950 | Cox | 244/153 |
| 3,327,975 | 6/1967 | Vaughan | 244/153 |
| 3,994,454 | 11/1976 | Worsham | 244/153 |
| 4,354,647 | 10/1982 | Carpenter | 244/153 |

*Primary Examiner*—Joseph F. Peters, Jr.
*Assistant Examiner*—Virna L. Mojoica
*Attorney, Agent, or Firm*—Basile and Hanlon

[57] ABSTRACT

A miniature kite includes a planar cover sheet, a frame, a control line and an elongate, flexible tail. The frame is formed of first and second diagonally overlapped, joined struts. A third strut overlaps and is joined to the intermediate overlap point of the first and second struts. The ends of the first, second and third struts are adhesively joined to one major surface of the sheet. The tail has an extremely long length relative to the length of the struts of the frame. Preferably, the first and second struts have a length of substantially 5.50 inches, the third or cross strut has a length of substantially 3.75 inches and the tail has a length of substantially 6 feet. The peripheral edges of the sheet have a shape substantially the same as the boundary between the ends of the first, and second and third struts.

18 Claims, 2 Drawing Sheets

MINIATURE KITE

RELATED APPLICATIONS

The present application is a continuation-in-part of application Ser. No. 434,920 filed on Nov. 13, 1989, now abandoned.

BACKGROUND OF THE INVENTION

1. Field of the Invention

The present invention relates to kites.

2. Description of the Relevant Art

Flying a kite is a well known and entertaining activity. Kites are generally constructed of a frame formed of interconnected, thin wood strips which are joined at their ends to the edges of a flexible cover sheet. A line or string is attached to the frame to enable the user to control the kite in flight. A tail is also attached to the kite to improve its stability.

A typical kite frame is formed of two struts which are disposed perpendicular to each other about an intermediate cross point. Other frames utilize two diagonally overlapped struts and a third, central cross strut.

The cover sheets have shapes coinciding with the boundary of the peripheral ends of the struts. Such cover sheets have diamond and other multi-sided shapes.

However, for stability and to provide sufficient lift to elevate the kite in flight, such kites are generally large in size and range from two to three feet in length and from one to two feet in width or larger. The size of such kites requires assembly for use. Further, if the kite is left in an assembled condition, it is cumbersome to transport or store between uses. Foldable kites have been devised to address certain of these problems; but such kites are still relatively large in size.

Despite these problems which have existed since the invention of the first kite, no one has heretofore been able to devise a miniature kite which, despite its small size, can still fly in the same manner as conventional large kites.

Thus, it would be desirable to provide a miniature kite which has a small size such that it can be left in an assembled condition at all times. It would also be desirable to provide a miniature kite which is easy to transport and store. It would also be desirable to provide a miniature kite which has sufficient lift and stability for suitable flight characteristics. Finally, it would be desirable to provide a miniature kite which has a relatively low manufacturing cost.

SUMMARY OF THE INVENTION

The present invention is a miniature kite which includes a planar sheet, a frame, a control line and an elongate, flexible tail. The frame is attached to one of the first and second, major, opposed surfaces of the sheet and includes first, second and third struts, each having first and second opposed ends.

The first and second struts are overlapped at an intermediate point along their length with corresponding first ends being spaced apart at a first predetermined distance and the second corresponding ends being spaced apart at a second predetermined distance. The third strut overlaps the first and second struts at the intermediate point, with the first and second ends thereof extending outward from the intermediate point between the first and second ends of the overlapped first and second struts. The ends of the first, second and third struts are joined to the first major surface of the sheet.

The flexible line is preferably connected to the intermediate point of the first, second and third struts and extends through the sheet and outward from the second major surface of the sheet.

In a preferred embodiment, the intermediate point defined by the overlap of the first and second struts is off center from the midpoint of each of the first and second struts. In this manner, the distance between the spaced, first ends of the first and second struts is less than the distance between the spaced, second ends of the first and second struts.

The first, second and third struts are preferably adhesively joined to the first major surface of the sheet and to each other at the intermediate point.

In an alternate embodiment, the peripheral edges of the sheet are folded over and adhesively joined to the first major surface of the sheet such that the folded over portion of the sheet overlays the first and second ends of each of the first, second and third struts.

In a preferred embodiment of the miniature kite, the first and second struts have a length of substantially 5.50 inches; while the third strut has a length of substantially 3.75 inches. The tail preferably has a length of substantially 6 feet. This configuration forms a miniature kite which has sufficient lift and control to operate in the same manner as larger kites. However, the miniature kite of the present invention is extremely small such that it can be easily transported and stored. Further, no disassembly of the miniature kite of the present invention is required for transport or storage.

Contrary to conventional kites which exhibit lift and fly only when the cover sheet is facing the oncoming wind, the miniature kite of the present invention can also fly when inverted or turned upside down with respect to the oncoming wind; in other words, the miniature kite of the present invention will fly with the struts facing the user.

The miniature kite of the present invention is formed of a relatively small number of small sized components which contribute to a low manufacturing cost. The miniature kite is easy to transport and store and has flight characteristics comparable to larger kites so as to be easy to fly and control during flight.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 3:
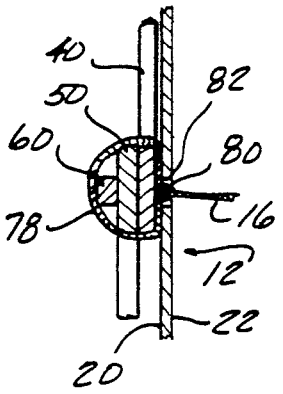
FIG. 3 is a cross sectional view generally taken along line 3—3 in FIG. 2.

Throughout the following description and drawing, an identical reference number is used to refer to the same component shown in multiple figures of the drawing.

Figure 1:
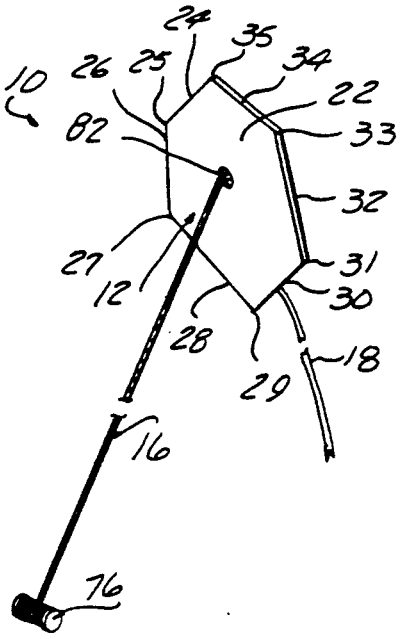
FIG. 1 is a perspective view of one embodiment of the miniature kite of the present invention.

Referring now to the drawing, and to FIG. 1 in particular, there is illustrated a miniature kite 10 constructed in accordance with the teachings of the present invention which has an extremely small size; but has sufficient lift and stability to operate as a conventional kite during flight.

Figure 2:
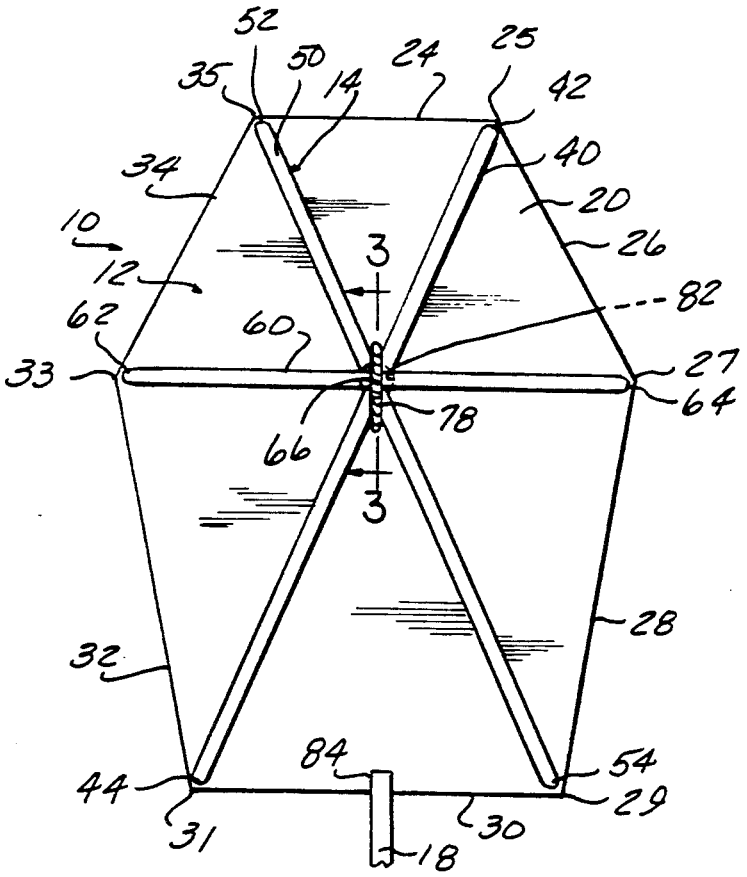
FIG. 2 is a back elevational view of the miniature kite shown in FIG. 1.

As shown in FIGS. 1 and 2, the miniature kite 10 includes a substantially planar cover sheet 12, a frame denoted in general by reference number 14, a control line 16 and an elongated, flexible tail 18.

The cover sheet 12 is formed of a single piece of flexible material, such as heavy paper, cardboard or light, thin paper or plastic. The sheet 12 has first and second major, opposed surfaces 20 and 22, respectively.

The overall shape of the flexible sheet 12 corresponds to the shape of the frame 14 as described hereafter. In the embodiment illustrated in FIGS. 1 and 2, the flexible sheet 12 is provided with six (6) contiguous, peripheral edges 24, 26, 28, 30, 32 and 34. The peripheral edges are separated by pointed apexes 25, 27, 29, 31, 33 and 35. In a preferred embodiment, the peripheral edges 24, 26, 28, 30, 32 and 34 have a substantially straight or planar form between the respective apexes 25, 27, 29, 31, 33 and 35.

The frame 14 is formed of first, second and third struts 40, 50 and 60, respectively. Each of the first, second and third struts 40, 50 and 60 has first and second opposed ends, such as the first and second ends 42 and 44, respectively, for the first strut 40, the first and second ends 52 and 54, respectively, for the second strut 50 and the first and second ends 62 and 64, respectively, of the third or cross strut 60. Each of the first, second and third struts, 40, 50 and 60 is formed of a thin, lightweight, substantially rigid material. Although lightweight wood, such a balsa wood, is utilized in a preferred embodiment of the present invention, the struts 40, 50 and 60 may be formed of any other suitable lightweight material including, for example, a plastic having the characteristics described above. It is anticipated that a plastic frame could be injected molded to form all three struts at once in a planar or substantially planar finished product.

Figure 4:
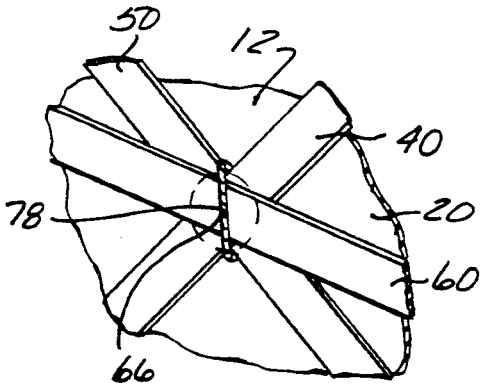
FIG. 4 is a partial, enlarged, perspective view showing the interconnection of the struts employed in the frame of the miniature kite shown in FIG. 2.

As shown in FIGS. 2, 3 and 4, the first and second struts 40 and 50, respectively, are disposed in an overlapping, diagonal orientation creating a substantially X shape. The first and second struts 40 and 50 are overlapped at an intermediate point denoted by reference number 66, with the first strut 40 disposed below the second strut 50. Further, the first and second struts 40 and 50 are connected together at the intermediate point 66 by suitable means, such as by an adhesive. Preferably, hot mill glue is employed to adhesively join the first and second struts 40 and 50 together at the intermediate point 66.

Preferably, the intermediate point 66 is located off center from the center point of each of the first and second struts 40 and 50 such that the spacing between the corresponding first ends 42 and 52 of the first and second struts 40 and 50 is less than the spacing between the corresponding second ends 44 and 54 of the first and second struts 40 and 50, respectively.

The third strut 60 overlays both of the first and second struts 40 and 50 at the intermediate point 66. The third strut 60 is joined to the second strut 50 by suitable means, such as by an adhesive. The first and second ends 62 and 64, respectively, of the third strut 60 extend outward from the intermediate point 66 and are disposed between the first and second ends of the first and second struts 40 and 50 as shown in FIG. 2.

The first and second ends of each of the first, second and third struts 40, 50 and 60, respectively, are joined to the first major surface 20 of the sheet 12. Preferably, an adhesive, such as hot mill glue, is employed to join the struts 40, 50 and 60 to the sheet 12. Due to the thickness of the struts, the third or uppermost disposed strut 60 will have a slight bow formed therein, as shown in FIG. 4. The second strut 50, which is sandwiched between the first strut 40 and the third strut 60 has a slight bend between its first and second ends 52 and 54, respectively. The bends in the second strut 50 and the third strut 60 form a slight bow in the planar sheet 12 when the frame 14 is attached to the sheet 12. However, the sheet 12 remains substantially planar when attached to the frame. It should be noted that adhesive may be applied to substantially the entire length of the first strut 40, except at the intermediate point 66, if desired.

In a preferred embodiment, the frame 14 has a predetermined small size sufficient to enable the kite 10 to be easily transported and yet have adequate lift for flight. Preferably, the first and second struts 40 and 50 have a length of substantially 5.50 inches, a width of 3/16 or 0.187 inches and a thickness of 0.040 inches. The third or cross strut 60 has a length of substantially 3.75 inches, a width of 3/16 or 0.187 inches and a thickness of 0.040 inches. The first and second ends of each of the first, second and third struts 40, 50 and 60, respectively, are disposed adjacent to one of the apexes 25, 27, 29, 31, 33 and 35 in the planar sheet 12. As noted above, the peripheral edges of the planar sheet 12 form a generally straight line between each pair of apexes so as to result in the six (6) sided figure shown in FIGS. 1 and 2. The miniature kite 10 thus has an overall length or height of less than 5.50 inches and an overall width of less than 3.75 inches. In a preferred embodiment, the kite 10 has a height of approximately 5.0 inches and a width of approximately 3.75 inches.

Figure 5:
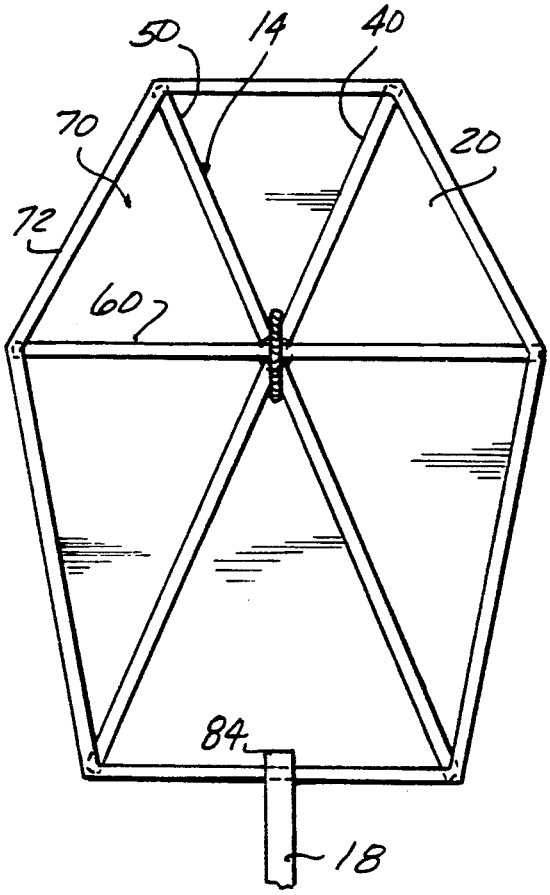
FIG. 5 is an elevational view of another embodiment of the miniature kite of the present invention.

An alternate embodiment of the flexible sheet is shown in FIG. 5. In this embodiment, the flexible sheet 70 has a peripheral folded over portion 72 formed along each of its peripheral edges. The folded over portion 72 extends inward from the peripheral edges a short distance so as to overlay the first major surface 20 of the flexible sheet 70. The folded over portion 72 is joined to the first major surface 20 of the sheet 70 by suitable means, such as by an adhesive. In this configuration, the folded over portion 72 overlays the first and second ends of the first, second and third struts, 40, 50 and 60, respectively and provides additional rigidity for the sheet 70.

Referring again to FIGS. 1–4, the miniature kite 10 of the present invention also includes a control line 16 which enables a user to control the height and direction of flight of the kite 10. In a preferred embodiment, the control line 16 is formed of a thin, lightweight string. Preferably, sewing thread of normal diameter is employed. The thread is wound around a conventional spool 76 at one end and can be unwound to any length to control the height of the kite 10 while in use. Alternately, any suitable reel or holder may be employed to contain the wound line 16.

The opposite end of the control line 16 is wrapped in a loop 78, shown in FIGS. 2, 3 and 4, about the intermediate point 66 formed by the overlapping first, second and third struts 40, 50 and 60, respectively. The control line 16 is tied in a knot 80, as shown in FIG. 3, to securely attach the control line 16 to the frame 14.

As further shown in FIGS. 1 and 3, an aperture 80 is formed in the sheet 12 approximate the intermediate point 66 of the frame 14. The aperture 82 extends through the sheet 12 and provides a passage for the control line 16 such that the control line 16 extends outward from the second major surface 22 of the sheet 12 as shown in FIGS. 1 and 3.

The tail 18 has a thin, elongate shape. Preferably, the tail 18 has a length of approximately 6 feet and a width of approximately $\frac{5}{8}$ inches. The tail 18 may be formed of any thin, flexible material, such as a thin, flexible fabric or ribbon. It has been found that use of grosgrain ribbon provided the best flying performance. The grosgrain ribbon is preferably installed with the grain side attached to the back surface of the kite. The tail 18 is secured at one end 84 to the bottom edge of the sheet 12 by suitable means, such as by an adhesive. The tail 18 provides stability for the kite 10 during flight. It has been discovered that the unique combination of the 6 foot length of the tail 18 and the small size of the frame 14 and sheet 12, as described above, provides a small size kite which has flight characteristics comparable to larger kites so as to enable the kite 10 to be flown in the same manner as larger kites without all of the disadvantages of the cumbersome, large kites during transport, storage and use.

Figure 6:
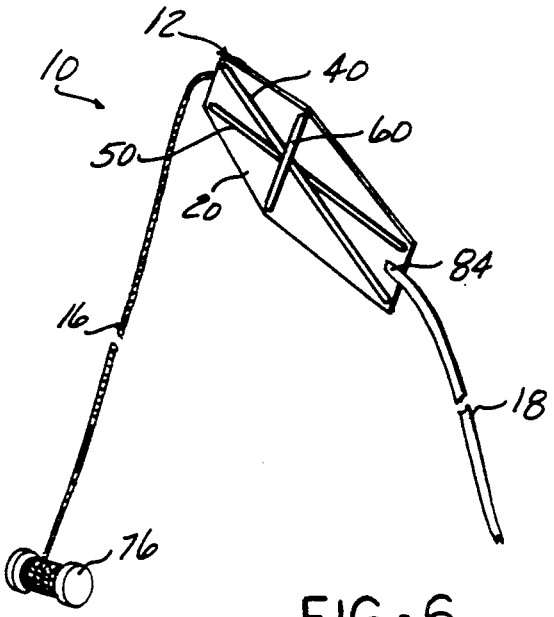
FIG. 6 is a perspective view showing the miniature kite of the present invention in an inverted, upside down, flight position.

In use, after the control line 16 has been secured to the frame 14, as described above and shown in FIG. 3, the control line 16 is unwound from the spool 76 to a suitable length to set the height of the kite 10 above the ground. The kite 10 may then be flown in a conventional manner in the orientation shown in FIG. 1 in which the second major surface 22 of the sheet 12 is disposed at an angle facing the oncoming wind. However, the unique size and configuration of the kite 10 also enables the kite 10 to fly in an inverted or upside down orientation as shown in FIG. 6. This orientation generally occurs spontaneously due to a gust of wind. In this configuration, the back or first major surface 20 of the sheet !2 faces the oncoming wind and the control line 16 extending through the aperture 82 extends from the intermediate point 66 over the top edge of the sheet 12 to the spool 76. With the control line 16 over the top edge of the sheet 12, the kite 10 is placed in a planar position closer to horizontal than that exhibited during normal flight. This flight orientation has been impossible with conventionally constructed kites and enhances the use of the miniature kite 10 of the present invention since the kite 10 may be flown in all wind conditions and in any direction or orientation. The kite 10 may be returned to its normal flight orientation as shown in FIG. 1 by simply exerting a slight pull or tug on the control line 16 to flip the kite 10 around to the position shown in FIG. 1.

As should be understood from the aforementioned, the present invention discloses a miniature kite having a surface area (approximated as height x width) of planar sheet 12 of less then 20.625 square inches, and in the preferred embodiment of less than 18.75 square inches. The length of tail 18 may vary between 3 feet to 7 feet depending on wind conditions, where the longer tail has been found to be more suitable for higher wind conditions. The surface area of the tail may fall within the range of 22.5 square inches to 52.5 square inches inclusive of the end limits, and the preferred embodiment having a tail of 45 square inches. Therefore, the miniature kite of the present invention can be described as having a tail length to kite height ratio falling within the range of 6.5 and 16.8 inclusive, where the preferred embodiment has a ratio of 14.4. In addition, the miniature kite of the present invention can also be described as having a tail surface area ($L \times WT$) to kite sheet surface area ratio ($H \times W$) falling within the range of 1.09 and 2.8 inclusive, preferably in the range of 1.2 to 2.8, where the preferred embodiment has a ratio of approximately 2.4. The miniature kite has a height H to width ratio in a range between 1.33 and 1.47 inclusive, and preferably a ratio of 4/3. The ratio or tail length to kite width is in a range between 9.6 and 22.4 inclusive, and in the preferred form a ratio of 19.2. The kite has been found to be capable of flying in winds ranging from 7 m.p.h. to 45 m.p.h. in the disclosed preferred embodiment.

In summary, there has been disclosed a unique miniature kite which has an extremely small size and yet exhibits flight characteristics to enable its use in the same manner as conventional large kites. The small size of the miniature kite of the present invention contributes to ease of use and eliminates the cumbersome task of transporting and storing larger sized kites. Finally, the miniature kite of the present invention, due to its small size and use of small components, has an extremely low cost.

What is claimed is:

1. A miniature kite comprising:

a substantially planar cover sheet having opposed first and second major surfaces;

a frame attached to the first major surface of the cover sheet to define an assembled kite having an overall frame height H and an overall frame width W, the frame including:

first, second and third struts, each having first and second opposed ends;

the first and second struts being overlapped at an intermediate point with corresponding first ends being spaced at a first predetermined distance apart and with corresponding second ends being spaced at a second predetermined distance apart;

the third strut overlapping the first and second struts at the intermediate point, with the third strut extending outward from the intermediate point and positioned between the first and second ends of the first and second struts;

the first, second and third struts being joined together at the intermediate point;

the first and second struts having a length of substantially 5.50 inches and the third strut having a length of substantially 3.75 inches; and the first and second ends of each of the first, second and third struts being joined to the first major surface of the cover sheet such that the cover sheet is substantially planar across the frame;

a flexible line connected to the intermediate point of the first, second and third struts and extending through the cover sheet and outward from the second major surface of the cover sheet; and a thin, elongated, flexible tail attached to and extending away from the cover sheet, the tail having a length L, wherein a ratio of kite tail length L to overall kite frame height H is in a range between 6.5 and 16.8 inclusive.

2. A miniature kite comprising:

a substantially planar cover sheet having opposed first and second major surfaces;

a frame attached to the first major surface of the cover sheet to define an assembled kite having an overall frame height H and an overall frame width W, the cover sheet and frame having an overall width W of less than 3.75 inches and an overall height H of less than 5.50 inches, the frame including:

first second and third struts, each having first and second opposed ends;

the first and second struts being overlapped at an intermediate point with corresponding first ends being spaced at a first predetermined distance apart and with corresponding second ends being spaced at a second predetermined distance apart;

the third strut overlapping the first and second struts at the intermediate point, with the third strut extending outward from the intermediate point and positioned between the first and second ends of the first and second struts;

the first, second and third struts being joined together at the intermediate point;

the first and second ends of each of the first, second and third struts being joined to the first major surface of the cover sheet such that the cover sheet is substantially planar across the frame;

a flexible line connected to the intermediate point of the first, second and third struts and extending through the cover sheet and outward from the second major surface of the cover sheet; and a thin, elongated, flexible tail attached to and extending away from the cover sheet, the tail having a length L, wherein a ratio of kite surface area defined as overall frame height H×overall frame width W, to kite tail surface area defined as length L×width $W_T$ is in a range between 1.09 and 2.8 inclusive.

3. The miniature kite of claim 1 wherein:

the tail has a length in a range between three feet and seven feet and a width of substantially ⅝ inches.

4. The miniature kite of claim 1 wherein the spacing between the first ends of the overlapped first and second struts is less than the spacing between the second ends of the first and second struts.

5. The miniature kite of claim 1 wherein the cover sheet has a plurality of the peripheral edges separated by apexes, the apexes being located adjacent to one of the first and second ends of the first, second and third struts.

6. The miniature kite of claim 5 wherein the peripheral edges of the cover sheet between adjacent apexes form a substantially straight line.

7. The miniature kite of claim 1 wherein:

the first and second ends of the first, second and third struts are adhesively joined to the sheet; and the overlapping intermediate portions of the first, second and third struts are adhesively joined together.

8. The miniature kite of claim 1 wherein:

the first, second and third struts are adhesively joined together at the intermediate point and at each first and second end to the cover sheet.

9. The miniature kite of claim 1 further comprising:

a folded over portion formed on the peripheral edge of the sheet, the folded over portion being joined to the first major surface of the sheet and overlaying the first and second ends of the first, second and third struts.

10. The miniature kite of claim 1 wherein:

the line is a long, thin, lightweight line attached to the first, second and third struts at the intermediate point and passes through the cover sheet adjacent the intermediate point.

11. A miniature kite comprising:

a substantially planar cover sheet having opposed first and second major surfaces;

a frame attached to the first major surface of the cover sheet to define an assembled kite having an overall frame height H and an overall frame width W, the cover sheet and frame having an overall width W of less than 3.75 inches and an overall height H of less than 5.50 inches, the frame including:

first second and third struts, each having first and second opposed ends;

the first and second struts being overlapped at an intermediate point with corresponding first ends being spaced at a first predetermined distance apart and with corresponding second ends being spaced at a second predetermined distance apart;

the third strut overlapping the first and second struts at the intermediate point, with the third strut extending outward from the intermediate point and positioned between the first and second ends of the first and second struts;

the first, second and third struts being joined together at the intermediate point;

the first and second ends of each of the first, second and third struts being joined to the first major surface of the cover sheet such that the cover sheet is substantially planar across the frame;

a flexible line connected to the intermediate point of the first, second and third struts and extending through the cover sheet and outward from the second major surface of the cover sheet; and a thin, elongated, flexible tail attached to and extending away from the cover sheet, the tail having a length L, wherein a ratio of kite tail length L to overall kite frame height H is in a range between 6.5 and 16.8 inclusive.

12. A miniature kite comprising:

a substantially planar cover sheet having opposed first and second major surfaces;

a frame attached to the first major surface of the cover sheet to define an assembled kite having an overall frame height H and an overall frame width W, the frame including:

first, second and third struts, each having first and second opposed ends, the first and second struts having a length of substantially 5.50 inches, the third strut having a length of substantially 3.75 inches;

the first and second struts being overlapped at an intermediate point with corresponding first ends being spaced at a first predetermined distance apart less than the distance between the corresponding second ends of the first and second struts;

the third strut overlapping the first and second struts at the intermediate point, with the third strut extending outward from the intermediate point and positioned between the first and second ends of the first and second struts;

the first, second and third struts being adhesively joined together at the intermediate point;

the first and second ends of each of the first, second and third struts being joined to the first major surface of the cover sheet such that the cover sheet is substantially planar across the frame;

a flexible line connected to the intermediate point of the first, second and third struts and extending through the cover sheet and outward from the second major surface of the cover sheet; and a thin, elongated, flexible tail attached to and extending away from the cover sheet, the tail having a length L of substantially six feet and a width of substantially $\frac{5}{8}$ inches, wherein the ratio of kite tail length L to overall kite frame height H is approximately 14.4.

13. A miniature kite comprising:

a substantially planar cover sheet having opposed first and second major surfaces;

a frame attached to the first major surface of the cover sheet to define an assembled kite having an overall frame height H and an overall frame width W, the frame including:

first, second and third struts, each having first and second opposed ends;

the first and second struts being overlapped at an intermediate point with corresponding first ends being spaced at a first predetermined distance apart and with corresponding second ends being spaced at a second predetermined distance apart;

the third strut overlapping the first and second struts at the intermediate point, with the third strut extending outward from the intermediate point and positioned between the first and second ends of the first and second struts;

the first, second and third struts being joined together at the intermediate point;

the first and second struts having a length of substantially 5.5 inches and the third strut having a length of substantially 3.75 inches; and the first and second ends of each of the first, second and third struts being joined to the first major surface of the cover sheet such that the cover sheet is substantially planar across the frame;

a flexible line connected to the intermediate point of the first, second and third struts and extending through the cover sheet and outward from the second major surface of the cover sheet; and a thin, elongated, flexible tail attached to and extending away from the cover sheet, the tail having a length L, wherein a ratio of kite surface area defined as overall frame height H×overall frame width W, to kite tail surface area defined as length L×width $W_T$ is in a range between 1.09 and 2.8 inclusive.

14. The miniature kite of claim 13 comprising:

the ratio of kite surface area to the tail surface area in a range between 1.2 and 2.8 inclusive.

15. The miniature kite of claim 13 wherein:

the tail has a length L in a range between 3 feet and 7 feet, and a width of substantially $\frac{5}{8}$ inches.

16. The miniature kite of claim 13 wherein the spacing between the first ends of the overlapped first and second struts is less than the spacing between the second ends of the first and second struts.

17. The miniature kite of claim 13 wherein the cover sheet has a plurality of peripheral edges separated by apexes, the apexes being located adjacent to one of the first and second ends of the first, second and third struts.

18. The miniature kite of claim 17 wherein the peripheral edges of the cover sheet between adjacent apexes form a substantially straight line.

* * * * *